US008839462B2

(12) United States Patent
Webster

(10) Patent No.: US 8,839,462 B2
(45) Date of Patent: Sep. 23, 2014

(54) PROTECTIVE GLOVE FOR USE IN ATHLETICS

(76) Inventor: Charles H. Webster, Randallstown, MD (US)

( * ) Notice: Subject to any disclaimer, the term of this patent is extended or adjusted under 35 U.S.C. 154(b) by 100 days.

(21) Appl. No.: 13/569,816

(22) Filed: Aug. 8, 2012

(65) Prior Publication Data

US 2013/0036523 A1 Feb. 14, 2013

Related U.S. Application Data

(60) Provisional application No. 61/521,137, filed on Aug. 8, 2011.

(51) Int. Cl.
*A41D 19/015* (2006.01)
*A63B 71/14* (2006.01)
*A63B 69/00* (2006.01)

(52) U.S. Cl.
CPC .... *A41D 19/01523* (2013.01); *A41D 19/01547* (2013.01); *A63B 71/141* (2013.01); *A63B 2069/0006* (2013.01); *A63B 71/143* (2013.01)
USPC ..... 2/20

(58) Field of Classification Search
USPC ..... 2/19, 20; D29/115, 117.1, 120.1
See application file for complete search history.

(56) References Cited

U.S. PATENT DOCUMENTS 57,283 A * 8/1866 Brown ..... 30/123.5
3,606,614 A * 9/1971 Dimitroff ..... 2/159
4,541,127 A * 9/1985 Gould ..... 2/19
RE32,566 E * 12/1987 Patton, Jr. ..... 2/16
D294,984 S * 3/1988 Green ..... D29/117.1
4,748,690 A 6/1988 Webster
5,214,799 A * 6/1993 Fabry ..... 2/161.6
5,345,609 A * 9/1994 Fabry et al. ..... 2/20
5,557,803 A 9/1996 Granich
5,581,809 A * 12/1996 Mah ..... 2/20
5,603,118 A * 2/1997 Solomon ..... 2/20
5,640,712 A * 6/1997 Hansen et al. ..... 2/20
D400,310 S * 10/1998 Chang ..... D29/120.1
5,819,313 A * 10/1998 McCrane ..... 2/16
5,987,642 A * 11/1999 Webster ..... 2/19
7,000,253 B1 * 2/2006 Kleinert ..... 2/20
7,895,669 B2 * 3/2011 Kleinert ..... 2/161.1

(Continued)

OTHER PUBLICATIONS www.palmgard.com, Mar. 28, 2010 (confirmation of date via internet archive).*

*Primary Examiner* — Shaun R Hurley
(74) *Attorney, Agent, or Firm* — Ober, Kaler, Grimes & Shriver; Royal W. Craig

(57) ABSTRACT

A glove worn within a conventional baseball mitt to protect the wrist and hand. The glove generally comprises a fitted glove of soft leather with a plurality of attached non-springy, shock absorbing cushions including a radioulnar cushion extending proximally one to three inches up the forearm from a first end at the wrist crease to a second end and in width a distance sufficient to cover the palmar side of the wrist, and a carpal cushion extending distally from the wrist crease a distance sufficient to cover the carpometacarpal joint of the hand and in width a distance sufficient to cover the carpometacarpal joint of all five digits, including the carpal cushion including a line of reduced padding, typically compressive stitching, extending from the first wrist crease edge to the distal edge which edge may be arcuate to provide additional protection and conform to the shape of the ball glove.

20 Claims, 4 Drawing Sheets

(56) References Cited

U.S. PATENT DOCUMENTS

| | | | | |
|---|---|---|---|---|
| 7,954,169 | B2 * | 6/2011 | Rumer et al. | 2/19 |
| 2001/0054190 | A1 * | 12/2001 | Kleinert | 2/19 |
| 2003/0188373 | A1 * | 10/2003 | Garneau | 2/161.1 |
| 2009/0007307 | A1 * | 1/2009 | Le et al. | 2/19 |
| 2009/0113592 | A1 * | 5/2009 | Iwata et al. | 2/19 |
| 2009/0288236 | A1 * | 11/2009 | Hawkes | 2/20 |
| 2010/0043113 | A1 * | 2/2010 | Clark et al. | 2/20 |

* cited by examiner

PROTECTIVE GLOVE FOR USE IN ATHLETICS

CROSS-REFERENCE TO RELATED APPLICATION(S)

The present invention derives priority from U.S. provisional application Ser. No. 61/521,137 filed 8 Aug. 2011.

BACKGROUND OF THE INVENTION

1. Field of the Invention

The present invention relates to protective sports equipment, and more particularly to a glove for use in conjunction with a baseball or softball glove to protect the carpal bones from trauma due to repetitive stress.

2. Description of the Background

Ball games such as baseball and softball that require the catching and throwing are popular with people of all ages and particularly popular with young athletes who compete youth leagues and seek to emulate their professional role models. However, at any level of play a thrown or batted ball can travel at high speed with the potential to injure players trying to catch such balls during practice and play. To combat this, baseball and softball gloves or mitts have long been part of the game as a way to aid the player in catching ball ant at the same time, of protecting the hand.

The conventional large baseball or softball glove currently used for catching is, however, not entirely effective in protecting the hand from the stress received when the ball impacts the glove at high speed. The padding in these large gloves is either insufficient or ineffective long before the glove reaches its maximum utility and players sometimes take additional steps in order to eliminate the sting that the player experiences when catching a particularly hard thrown or batted ball. Some gloves permit the player to remove his index finger from the glove through an aperture located across the back of the glove, thereby placing additionally layers of leather between the index finger and the ball, This slightly increases the padding effect of the glove but only for one finger. Most players don a thin, tight fitting batting glove under their mitt. However, batting gloves are designed for increasing a batter's grip. They are typically made of unpadded calf skin and are ineffective for use as a protective inner glove. Protective palm pads also have been used, but these are difficult t maintain in the proper location and inhibit hand flexibility within the glove because of the indiscriminately positioned and excess padding in the crease areas of the palm. Such shock absorbing protective cushions or pads also suffer from their elastic characteristic which rebounds or propels the ball away from or out of the glove on impact, thereby working against the proper catching function of the outer mitt and hand.

One example of a protective inner athletic glove designed for wear inside a larger baseball or softball glove is shown in U.S. Pat. No. 5,557,803 to Granich et at, which has shock absorbent, flexible material with shape memory properties covering the fingers, the base of the fingers, and the palm or the metacarpal bones of the hand. In addition, the wrist and forearm section (18, 12, 14) has shock absorbent closed cell foam. Unfortunately the shock absorbent material 22 in the fingers only protects the pads of the fingers but fails to cover the interphalangeal articulations of the hand, e.g., the hinge joints between the finger bones, These are critical areas of the finger inasmuch as these bones are the most vulnerable part of the fingers and need protection. Moreover, padding 22 at the palm is unnecessary and uncomfortable because this area is protected by the padding in the heel of every baseball glove. Also, the wrist guard padding 21 completely surrounds the entire wrist, which is unnecessary and confines movement. All baseball fielders require a certain touch and "feel" from their glove in order to properly do their job, and any protective inner glove detracts from the touch and feel of the baseball glove. This is especially true when the protective inner glove has padding. The key, then, is to minimize the padding, placing it only in areas where absolutely needed, and not placing it elsewhere. It is essential to protect a specific area at the palmar side of the wrist joint. As seen in FIG. 1, the wrist joint, or carpus, is a complex arrangement between the forearm and the carpal bones, stabilized by strong, ligamentous attachments. Not actually a single joint, but rather a collection of multiple joints, the wrist contains eight small, irregularly-shaped carpal bones 90, arranged in two rows, proximal and distal (The eight bones together are called the carpus). There is a midcarpal joint between the two rows, as well as intercarpal joints between individual bones in each row. The distal row articulates with the five metacarpal 91 bones while the proximal row articulates with the two bones of the forearm, the radius 92 and ulna 93, forming the radiocarpal and ulnocarpal joints. In addition, the distal radius and ulna articulate with each other, forming the distalradioulnar ("DRU") joint 94. The DRU joint allows the radius and ulna to rotate around each other, so that the forearm can be pronated (rotated palm downward) and supinated (rotated palm upward). The movements of the other wrist joints are complex; together they produce the wrist movements of flexion (bending toward the palm), extension (bending backward, also called dorsiflexion), radial deviation (bending toward the radial side), and ulnar deviation (bending toward the ulnar side). The joints of the wrist are enclosed by a fibrous joint capsule, and are further bound together by multiple ligaments which blend with the capsule. Movement of the fingers is carried out by several groups of muscles. The muscles that flex the fingers, primarily flexor digitorum superficialis and flexor digitorum profundus, are located in the palmar aspect of the forearm. These muscles each give rise to four long tendons that pass through the palmar side of the wrist and hand. A total of the nine long flexor tendons (two for each finger and one for the thumb) pass together through a space called the carpal tunnel, the floor of which is formed by the carpal bones, before diverging in the palm on their way to the digits. The median nerve also passes through the carpal tunnel and supplies sensation to the palmar surface of the hand, including the thumb and fingers, except for the little finger and the ulnar half of the ring finger, which are supplied by the ulnar nerve. Blood is supplied to the hand by a complex web of blood vessels passing through both the dorsal and palmar sides of the wrist.

For present purposes it is essential to provide protection for the distal radioulnar joint 94 (FIG. 1) beginning at approximately the wrist crease 96 and extending proximally away from the wrist from one to three inches and preferably approximately 1.25 inches, but not the back or surrounding areas.

The present inventor previously disclosed an improved protective inner athletic glove designed for wear inside a larger baseball or softball glove. U.S. Pat. No. 4,748,690, which is incorporated here by reference, presents an inner glove characterized by protective, non-springy, shock-absorbing cushions covering one or more inner fingers from their base to, at least, the proximal interphalangeal joint, and the upper pain including the distal ends of the meta carpal bones and the metacarpophanlangeal joint. Two optional cushions were also potentially provided to cover full length of the metacarpal bones without inhibiting opposition of the thumb and fifth digit (i.e. the little finger). The cushions were attached to the glove and covered by an outer layer of leather to help protect critical areas of the fingers and palm and reduce the incidence of injury that can occur during long hours of play. Although the inventor's prior protective glove covered the interphalangeal articulations of the hand, it still had shortcomings in that it specifically failed to protect the carpal bones 90 of the wrist. Although it is desirable to catch a ball in the web of the glove, it is common for balls to be caught (or mis-caught) lower on the glove at the lower palm or wrist with the wrist in an extended, pronated position. Repetition of such impacts, studies have shown, result in microvascular changes in the hands of baseball players that results in poor blood flow and a condition called digital ischmia. This, along with direct trauma to the nerves may result in pain, weakness, tingling or numbness in the hand as well as swelling and deformity, particularly of the middle digits. Another risk is fracture of one or more carpal bones. Such fractures commonly go unnoticed in baseball players who then suffer from tears to the ligaments or tendons of the hand from repeated motion over the sharp edges of the fractured bone.

It is, therefore, an object of this invention to provide a protective inner athletic glove to be used with a larger, outer baseball or softball glove for catching small, hard balls during play.

It is another object of this invention to provide a protective inner athletic glove with minimal padding only in areas where absolutely needed for protection so as not to impede the natural motion of the hand or reduce player ability to catch.

It is another object of this invention, therefore, to provide a tight fitting protective inner athletic glove with non-springy cushions to enhance the catching characteristics of the outer baseball or softball glove.

It is still another object to accomplish all the foregoing with a protective inner athletic glove having the following specific combination of sufficient non-springy cushions in the following critical areas to protect the hand and wrist on impact thereby reducing the incidence of injury:

- a radioulnar cushion the palmar side of the wrist joint beginning at approximately the wrist crease and extending proximally away from the wrist from one to three inches and preferably approximately 1.25 inches;
- a carpal cushion beginning at the wrist crease and extending distally to cover the carpometacarpal joint of the hand, and extending in width a distance sufficient to cover the carpometacarpal joint of all five digits.

Further objects and advantages of this invention will become more apparent in light of the following drawings and description of the preferred embodiment of the invention.

SUMMARY OF THE INVENTION

These and other objects are met by the present invention which provides a protective inner athletic glove to be worn within a conventional baseball or softball glove or mitt to protect the wrist and hand of a wearer. The glove of the present invention includes a glove of soft leather or other material closely fitted to the hand and a plurality of non-springy, shock absorbing cushions attached to the glove only over certain defined areas and sewn thereto in a particular pattern so as to cover portions of both hand and wrist. The cushions include a radioulnar cushion having an area of padding having a first end at the wrist crease and extending in length proximally up the forearm to a second end, a distance from one to three inches and extending in width a distance sufficient to substantially cover the palmar side of said wrist. Additionally, a carpal cushion having an area of padding with a first end also beginning at the wrist crease and extending in length distally to a second edge a distance sufficient to cover the carpometacarpal joint of the hand and extending in width a distance sufficient to cover the carpometacarpal joint of all five digits of said hand. The carpal cushion is provided with a line of reduced padding, typically compressive stitching, extending from the first wrist crease edge to the distal edge to predispose the cushion to fold along that line as an aid to articulation. The distal edge of the carpal cushion is preferably arcuate to conform to the heel of the baseball/softball glove or mitt, thereby maintaining a uniform tactile feel.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings, Wherever possible, the same reference numbers will be used throughout the drawings to refer to the same or like parts.

Figure 3:
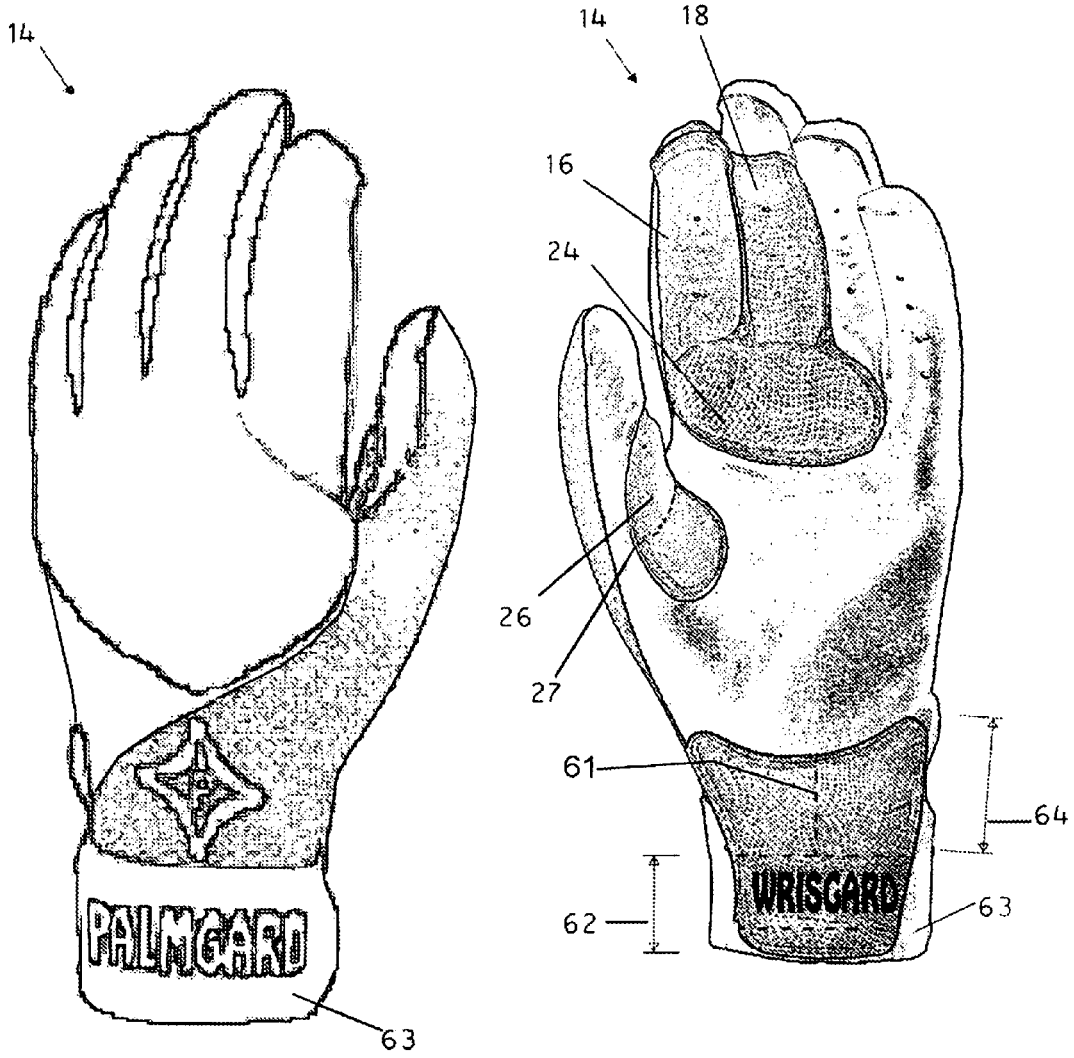
FIG. 3 is a front and back view of a glove according to the present invention.
Figure 4:
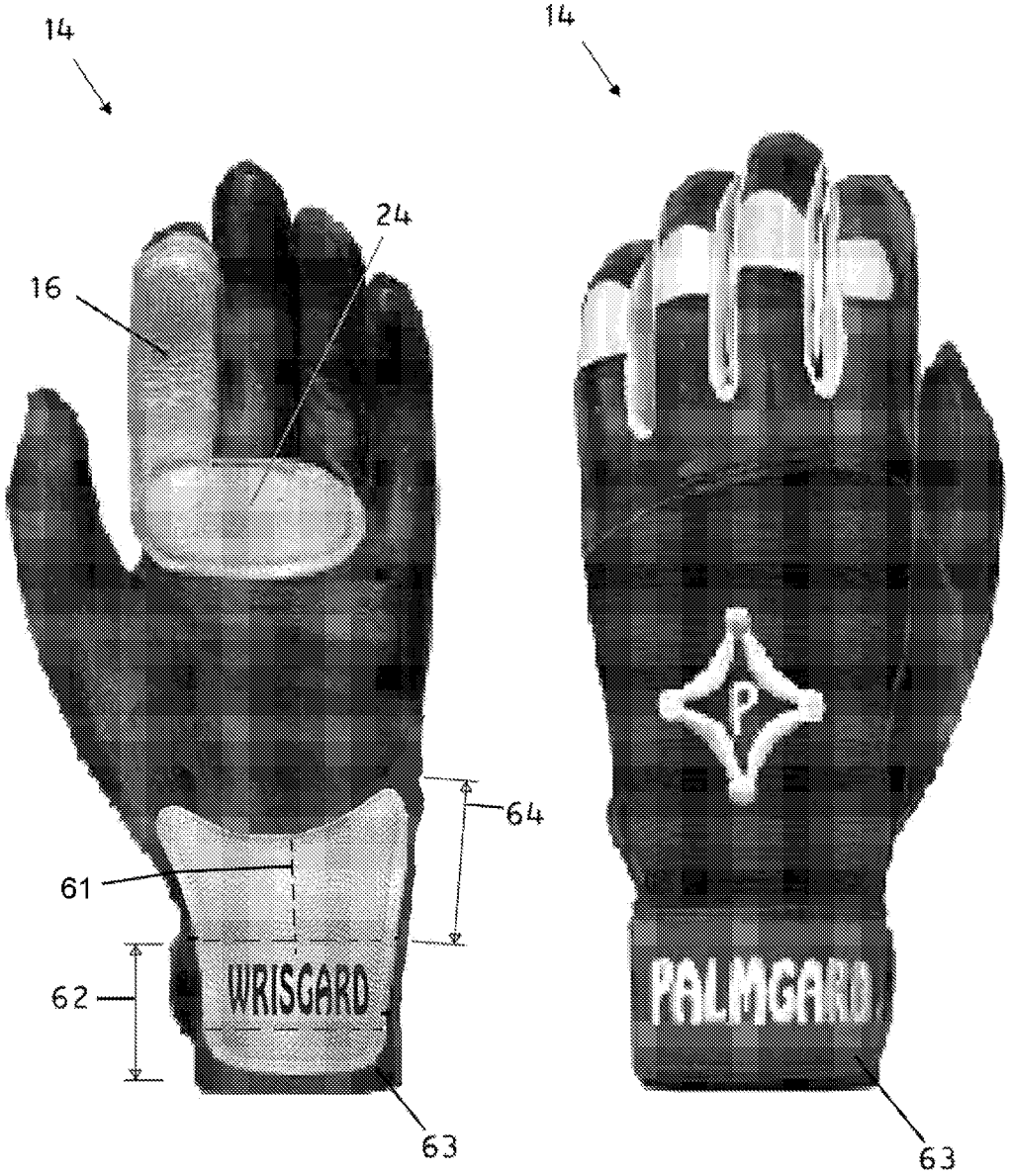
FIG. 4 is a front and back view of an alternate glow according to the present invention.
Figure 5:
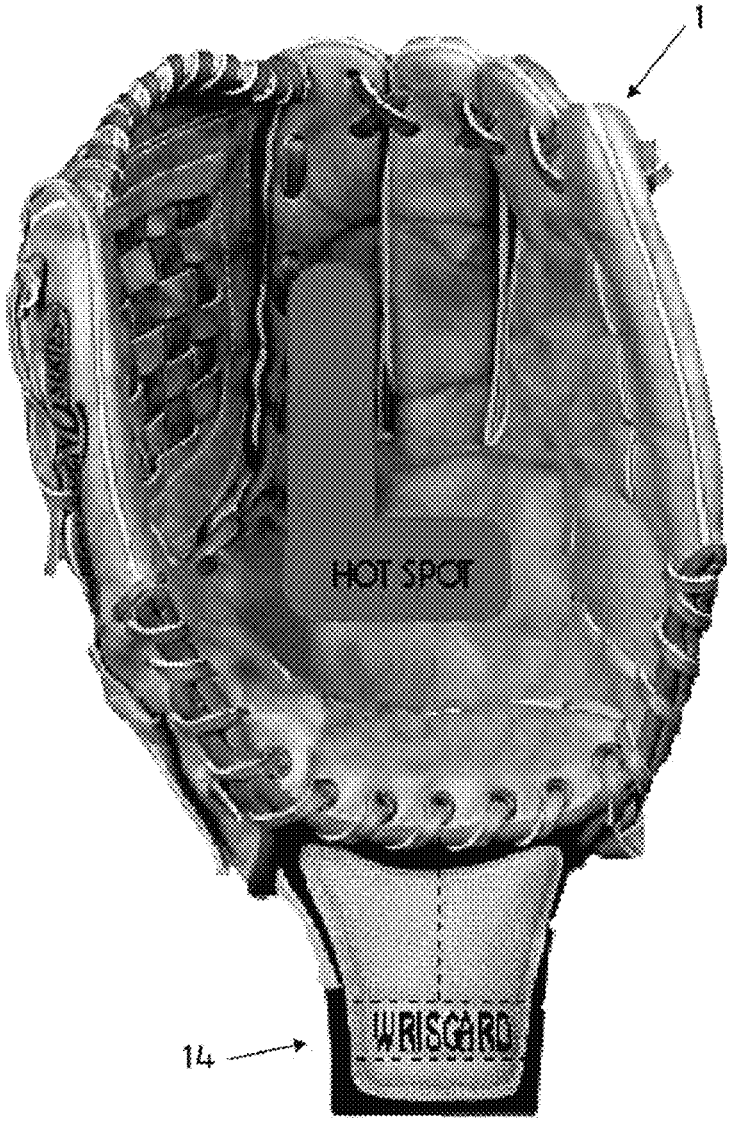
FIG. 5 is a front view of a glove according to the present invention inserted within a baseball glove/mitt.

With collective reference to the figures and specifically to FIG. 3 there is shown a protective glove 14 embodying the features of the present invention. The glove is preferably constructed of a thin flexible leather material such as calf skin leather but may be constructed of any similar, thin flexible natural or synthetic material. The glove 14 is preferably tight fitting to the hand and wrist of the wearer and is provided with a plurality of non-springy, cushions on the surface of glove on the critical area of the hand and wrist.

Figure 2:
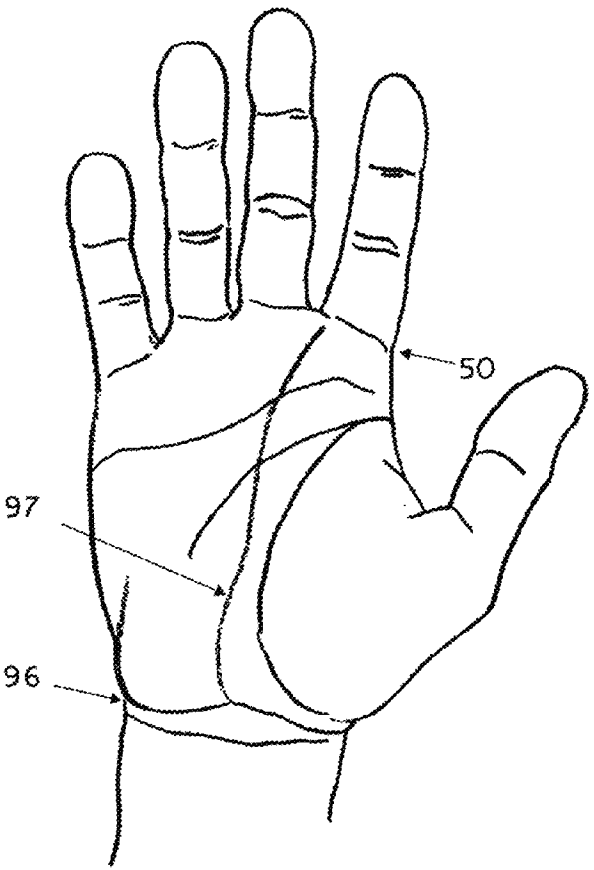
FIG. 2 is a diagram of the palmar surface features of the human hand and wrist.
Figure 1:
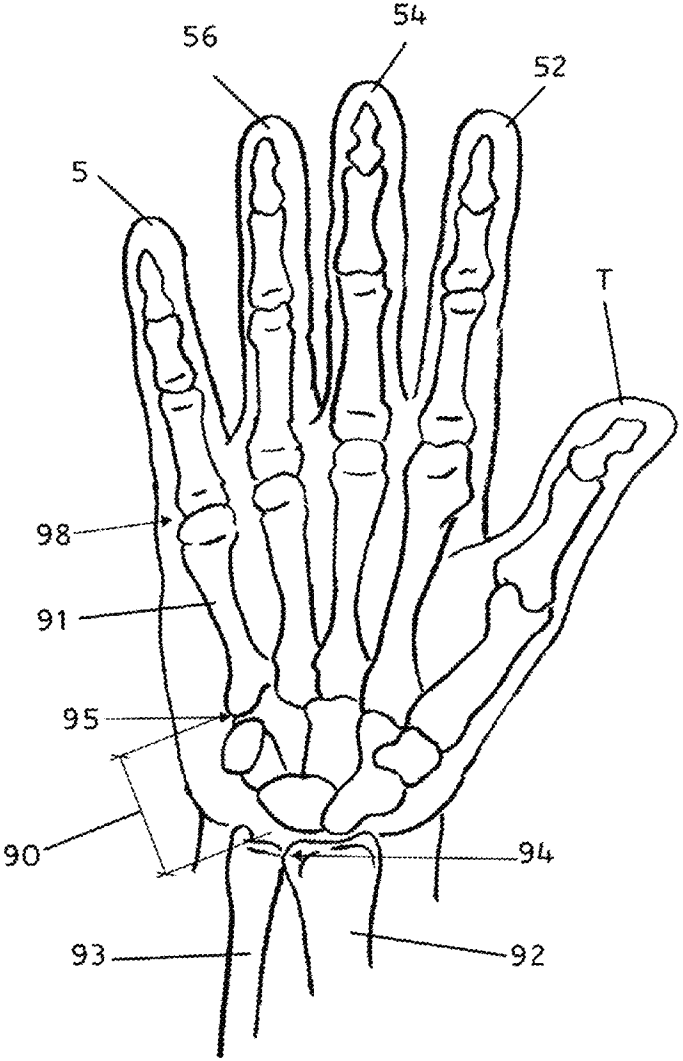
FIG. 1 is a diagram of the bones of the human hand and wrist.

Referring back to FIGS. 1-2, the critical areas of the wrist include the distal radioulnar joint 94 and the carpal bones 90 extending from the radioulnar joint 94 up to and including the proximal ends of the metacarpals 91 at the carpometacarpal joint 95 for each digit.

Specifically, a radioulnar cushion 62 protects the distal radioulnar joint 94, beginning at approximately the wrist crease 96 and extending proximally away from the wrist from one to three inches and preferably approximately 1.25 inches, In addition, a carpal cushion 64 protects the carpal bones and the proximal ends of the metacarpals at the carpometacarpal joint for each The radioulnar cushion 62 extends laterally approximately 2.5 inches to substantially cover the palmar side of the wrist and is essentially centered on the wrist in this region. In a preferred embodiment the radioulnar cushion 62 may be integrated with or affixed to an adjustable wrist band 63 of the glove 14.

The wrist band 63 of the glove 14 is preferably a band of elastic material or adjustable belt approximately 1.5 inches wide and extending around the wrist, the band 63 forming a look of adjustable circumference to accommodate the variation in the wrist and hand sized of various wearers.

As with all of the cushions of the present invention, the radioulnar cushion 62 is preferably affixed to the glove 14 and covered by another layer of leather for protection. In an alternate embodiment the cushion 62 is affixed to a leather cover and the cover then affixed to the leather glove 14. In yet another embodiment the leather cover material is provided in a thicker form such that the leather cover itself comprises the cushion and is affixed directly to the glove 14. It should be noted that the dimensions provided herein for the cushions presume an average sized male. Such dimensions may be scaled appropriately to conform to the physiology of smaller or larger sized males and females.

The carpal cushion 64 protects the carpal bones and the proximal ends of the metacarpals at the carpometacarpal joint for each digit. The cushion 64 also begins at the wrist crease 96 and extends distally from one to three inches and preferably approximately 1.5 inches toward and past the carpometacarpal joint 95. The distal end of the carpal cushion 64 may preferably be provided in an arcuate or crescent form, extending further at the first and fifth digits to provide a natural cupping of the cushion as the digits are opposed during the catching action. One or more vertical rows of stitching 61 are provided along the carpal cushion 64 extending distally from the point at which the median crease 97 (see FIG. 1) joins the wrist crease 96 and intersecting the crescent end of the cushion 64, preferably bisecting the crescent edge. The stitching compresses the cushion 64 along its length and provides a preferred fold or crease line that facilitates the natural opposition of the thumb T and fifth digit 5 to capture a ball with the baseball mitt or glove 1.

The glove 14 is additionally provided with an index cushion 16 to protect the inside portion of the index finger 52. As depicted, the shock absorbing, non-springy index cushion 16 for the second digit 52 preferably begins just above the bottom of this digit at the palmar digital crease 50 and extends upwardly to at least a point beyond the distal interphalangeal joint approximately midway between this joint and the end of the second digit 52.

The glove 14 is additionally provided with a middle cushion 18 to protect the inside portion of the index finger 54. As depicted, the shock absorbing, non-springy cushion 18 for the third digit 54 preferably begins just above the bottom of this digit at the palmar digital crease 50 and extends upwardly to at least a point beyond the distal interphalangeal joint approximately midway between this joint and the end of the third digit 54.

The glove 14 is additionally provided with an MCP cushion 24 at the metacarpophalangeal joints 98 of the second, third and fourth digits 52, 54, 56 to protect these joints at or near the pocket of the baseball mitt 1. As depicted, the shock absorbing, non-springy cushion 24 for the MCP joints preferably begins just below the palmar digital crease 50 and extends down approximately one inch to the distal ends of the metacarpals. The MCP cushion 24 is wide enough to cover at least the MCP joint of the second through fourth digits and leather of the cushion may abut the middle cushion 18 and index cushion 16 at the palmar digital crease. However, the cushion 24 is separately and apart from the digital cushions and separated by at least a line of stitching in the leather so as to provide a natural crease line that facilitates ease of movement within the baseball glove or mitt.

The glove 14 is additionally provided with an additional cushion 26 at the metacarpophalangeal ("MCP") joint of the first digit (the thumb) to protect this joint at or near the pocket of the baseball mitt where it is likely to be impacted. As depicted, the shock absorbing, non-springy cushion 26 for the MCP joint of the first digit preferably begins just below the joint and extends distally to a point just above the joint and is wide enough to cover the joint. In order to facilitate the natural opposition of the digits when catching a ball in the mitt, the MCP cushion 26 is preferably provided with a line of stitching 27 across the cushion substantially perpendicular to the axis of the digit forming a line of compressed padding within the cushion that provides a natural fold point.

The particular combination of index cushion 116, MCP cushion 24 with the radioulnar cushion 62 and carpal cushion 64, with or without additional cushion 26 works synergistically to maximize protection of the metacarpal bones without inhibiting opposition of the thumb and fifth digit (i.e. the little finger), including the proximal ends of the metacarpals at the carpometacarpal joint for each digit, and the wrist crease 96, again without inhibiting movement of the wrist. This provides optimal protection of the fielding hand with minimal opposition to movement or distortion of tactile sensation.

What is claimed is:

1. A protective inner athletic glove to protect the wrist and hand of a wearer in conjunction with an outer baseball or softball glove when catching small, hard balls, comprising a glove closely fitted to said hand, and a plurality of non-springy, shock absorbing cushions attached to said glove and covering portions of said hand and wrist, said cushions comprising:

a single radioulnar cushion comprising padding having a first end at the wrist crease and extending in length proximally up the forearm to a second end a distance from one to three inches, and extending in width a distance sufficient to substantially cover the palmar side of said wrist; and a carpal cushion comprising padding having a first end beginning at the wrist crease and extending in length distally to a second edge a distance sufficient to cover the carpometacarpal joint of the hand, and extending in width a distance sufficient to cover the carpometacarpal joint of all five digits of said hand, said carpal cushion further comprising a line of reduced padding extending from said first edge to said second edge thereby predisposing said cushion to fold along said line.

2. The protective inner athletic glove of claim 1 wherein said second edge of said carpal cushion is arcuate so as to extend further over the metacarpal bone of the first and fifth digits of said hand.

3. The protective inner athletic glove of claim 1 wherein said line of reduced padding is comprised of a line of stitching compressing said padding.

4. The protective inner athletic glove of claim 1 further comprising an index cushion comprising padding having a first edge beginning at the palmar digital crease and extending distally up the second digit of said hand past the distal interphalangeal joint.

5. A protective inner athletic glove for wear inside an outer baseball or softball glove to protect the wrist and hand of a wearer when catching a ball, comprising a single-layer leather glove for conforming to a hand of said wearer, and a plurality of non-springy, shock absorbing cushions attached to said glove and covering portions of said hand and wrist, said cushions comprising, a radioulnar cushion comprising a single unitary section of padding having a defined edge along a crease of said wrist and extending to a second edge on a palmar side of said wrist: and a carpal cushion comprising a section of padding having a first defined edge along a crease of said wrist crease and extending to a second defined edge below a carpometacarpal joint of the user's hand, said carpal cushion having a width sufficient to cover the carpals of all five digits of said hand.

6. The protective inner glove of claim 5, wherein said radioulnar cushion extends from said first edge within a range of from one to three inches to said second edge and completely covers the palmar side of said user's wrist.

7. The protective inner glove of claim 6, wherein said radioulnar cushion extends from said first edge 1.25 inches to said second edge.

8. The protective inner glove of claim 5, wherein said carpal cushion further comprises a seam forming a line of reduced padding extending transversely from said first edge to said second edge for predisposing said cushion to fold along said line.

9. The protective inner athletic glove of claim 5 wherein said second edge of said carpal cushion is arcuate so as to conform to the carpals of the first and fifth digits of said hand.

10. The protective inner athletic glove of claim 8, wherein said seam is formed from a line of stitching compressing said padding.

11. The protective inner athletic glove of claim 10 further comprising an index cushion comprising padding having a first edge beginning at a palmar digital crease and extending distally up a second digit of the user's hand past a distal interphalangeal joint.

12. The protective inner athletic glove of claim 5 wherein said carpal cushion is defined by a line of reduced padding extending transversely from said first edge to said second edge.

13. The protective inner athletic glove of claim 12 wherein said line of reduced padding is formed by compression stitching.

14. The protective inner athletic glove of claim 5 wherein the first edge of said carpal cushion is arcuate to conform to a heel of the outer baseball or softball glove.

15. The protective inner athletic glove of claim 5 further comprising an index cushion having a first defined edge at the palmar digital crease of the user's second digit and extending upwardly to a. second defined edge between the interphalangeal joint and distal end of sad second digit to protect the inside of the second digit.

16. The protective inner athletic glove of claim 15 further comprising a middle cushion having a first defined edge at the palmar digital crease of the user's third digit and extending upwardly to a second defined edge between the interphalangeal joint and distal end of sad third digit to protect the inside of the index finger.

17. The protective inner athletic glove of claim 16 further comprising a first metacarpal cushion at the metacarpophalangeal joints of the second, third and fourth digits to protect said metacarpophalangeal joints.

18. The protective inner athletic glove of claim 17, wherein said index cushion, middle cushion, and first metacarpal cushion are integrally formed and hingedly connected by compression-stitched seams delineating said index cushion, middle cushion, and first metacarpal cushion.

19. The protective inner athletic glove of claim 5 further comprising a second metacarpal cushion at the metacarpophalangeal joint of the first digit to protect said metacarpophalangeal joint.

20. The protective inner athletic glove of claim 19 wherein said second metacarpal cushion comprises a seam of compression stitching traversing said second metacarpal cushion substantially perpendicular to the axis of the first digit to facilitate natural opposition of said first digit with said second through fifth digits when catching a ball in the mitt.

* * * * *